US011685498B2

(12) United States Patent
Namba et al.

(10) Patent No.: US 11,685,498 B2
(45) Date of Patent: Jun. 27, 2023

(54) SHIP MANEUVERING SYSTEM

(71) Applicant: SUZUKI MOTOR CORPORATION, Hamamatsu (JP)

(72) Inventors: Masahiro Namba, Hamamatsu (JP); Takashi Kawata, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 176 days.

(21) Appl. No.: 17/239,164

(22) Filed: Apr. 23, 2021

(65) Prior Publication Data

US 2021/0331777 A1 Oct. 28, 2021

(30) Foreign Application Priority Data

Apr. 28, 2020 (JP) ..... 2020-079388

(51) Int. Cl.
*B63H 25/42* (2006.01)
*B63H 21/21* (2006.01)

(52) U.S. Cl.
CPC ..... *B63H 25/42* (2013.01); *B63H 21/21* (2013.01)

(58) Field of Classification Search
CPC ..... B63H 25/42; B63H 21/21; B63H 20/12; B63H 2020/003
See application file for complete search history.

(56) References Cited

U.S. PATENT DOCUMENTS 7,438,013 B2 * 10/2008 Mizutani ..... B63H 20/10 114/144 R
2012/0231680 A1 * 9/2012 Ono ..... B63H 21/21 440/1

FOREIGN PATENT DOCUMENTS

JP 2011-020468 A 2/2011
JP 4884504 B2 * 2/2012

* cited by examiner

*Primary Examiner* — Anthony D Wiest
(74) *Attorney, Agent, or Firm* — Stein IP LLC

(57) ABSTRACT

There is provided a ship maneuvering system including: a turning operation device configured to output a turning operation signal corresponding to a turning operation; a turning control device configured to change a direction of each of ship propulsion machines based on the turning operation signal; an output operation device configured to output an output setting signal indicating an output of a power source of each of the ship propulsion machines set by an output setting operation; and an output control device configured to increase or decrease the output of the power source of each of the ship propulsion machines based on the output setting signal. When the turning control device fails, the output control device turns a ship by making outputs of power sources of the ship propulsion machines different from each other based on the turning operation signal.

4 Claims, 4 Drawing Sheets

SHIP MANEUVERING SYSTEM

CROSS-REFERENCE TO RELATED APPLICATIONS

This application is based on Japanese Patent Application No. 2020-079388 filed on Apr. 28, 2020, the contents of which are incorporated herein by way of reference.

TECHNICAL FIELD

The present invention relates to a ship maneuvering system for performing ship maneuvering control on a ship by using two or more ship propulsion machines.

BACKGROUND

Two or more ship propulsion machines may be attached to a ship to propel the ship. A ship maneuvering system for performing ship maneuvering control on such a ship includes: a turning operation device for an operator to turn the ship; a turning control device configured to change a direction of each ship propulsion machine based on a turning operation signal output from the turning operation device; an output operation device for the operator to set an output of a power source of each ship propulsion machine; and an output control device configured to increase or decrease the output of the power source of each ship propulsion machine based on an output setting signal output from the output operation device.

For example, the turning operation device includes a handle provided in front of a maneuvering seat and a detector configured to detect an operation direction and operation amount of the handle and to output a turning operation signal. The turning control device includes an actuator, such as a pump and a cylinder, for rotating each ship propulsion machine in a horizontal direction, and a control circuit configured to control drive of the actuator based on the turning operation signal. The output operation device includes a throttle lever provided on a side of the maneuvering seat and a detector configured to detect a position of the throttle lever and to output an output setting signal. The output control device includes a control circuit configured to control a throttle opening degree in each ship propulsion machine based on the output setting signal.

Further, Patent Literature 1 below describes a ship maneuvering device provided on a ship in which two or more outboard machines are arranged.

Patent Literature 1: JP-A-2011-020468

In the above ship maneuvering system, when the turning control device fails, it is impossible for the turning operation device to change the direction of each ship propulsion machine. As a result, it is impossible or extremely difficult to turn the ship. When the turning control device fails during the operation of the ship, the operator may send a rescue signal and wait for rescue.

Regarding this point, the ship maneuvering device shown in FIG. 1 in Patent Literature 1 includes, as components for performing maneuvering on outboard machines (3L, 3R), a handle (5), a handle controller (7) including a steering angle detection unit configured to detect a steering angle of the handle (5), actuators (11L, 11R) for maneuvering the outboard machines (3L, 3R), outboard machine maneuvering controllers (12L, 12R) configured to drive the actuators (11L, 11R), and a communication line (14) connecting the handle controller (7) and the outboard machine maneuvering controllers (12L, 12R). In addition, the ship maneuvering device includes a remote controller (6) for adjusting a throttle opening degree of each of the outboard machines (3L, 3R). The remote controller (6) includes remote control operating levers (61L, 61R). The ship maneuvering device has a configuration in which, when any of the handle (5), the handle controller (7) and the communication line (14) fails, the actuator (11L, 11R) is driven to maneuver the ship based on a deviation of a lever position of the remote control operating lever (61L, 61R) of the remote controller (6).

However, the ship maneuvering device has a configuration in which, when the handle (5), the handle controller (7) or the communication line (14) fails, the remote control operating lever (61L, 61R) is used instead of the handle (5) to control the actuator (11L, 11R) for maneuvering to enable maneuvering of the ship. That is, when the configuration of the ship maneuvering device is described while being applied to the configuration of the ship maneuvering system described above, the ship maneuvering device has a configuration in which, when the turning operation device fails, the turning control device is controlled by using the output operation device instead of the turning operation device to turn the ship. In the ship maneuvering device, when the turning control device, i.e., the actuator (11L) or the actuator (11R) fails, it may be impossible or extremely difficult to turn the ship.

The present invention has been made in view of the above circumstances, and an object of the present invention is to provide a ship maneuvering system which can turn a ship by operating the turning operation device even when the turning control device fails.

SUMMARY

In order to solve the above problems, there is provided a ship maneuvering system for performing ship maneuvering control on a ship attached with two or more ship propulsion machines, the ship maneuvering system including: a turning operation device configured to output a turning operation signal corresponding to a turning operation for turning the ship by changing a direction of each of the ship propulsion machines; a turning control device configured to change the direction of each of the ship propulsion machines based on the turning operation signal output from the turning operation device; an output operation device configured to output an output setting signal indicating an output of a power source of each of the ship propulsion machines set by an output setting operation for setting the output of the power source of each of the ship propulsion machines; and an output control device configured to increase or decrease the output of the power source of each of the ship propulsion machines based on the output setting signal output from the output operation device. When the turning control device fails, the output control device turns the ship by making outputs of power sources of the two or more ship propulsion machines different from each other based on the turning operation signal output from the turning operation device.

DESCRIPTION OF EMBODIMENTS

Figure 1:
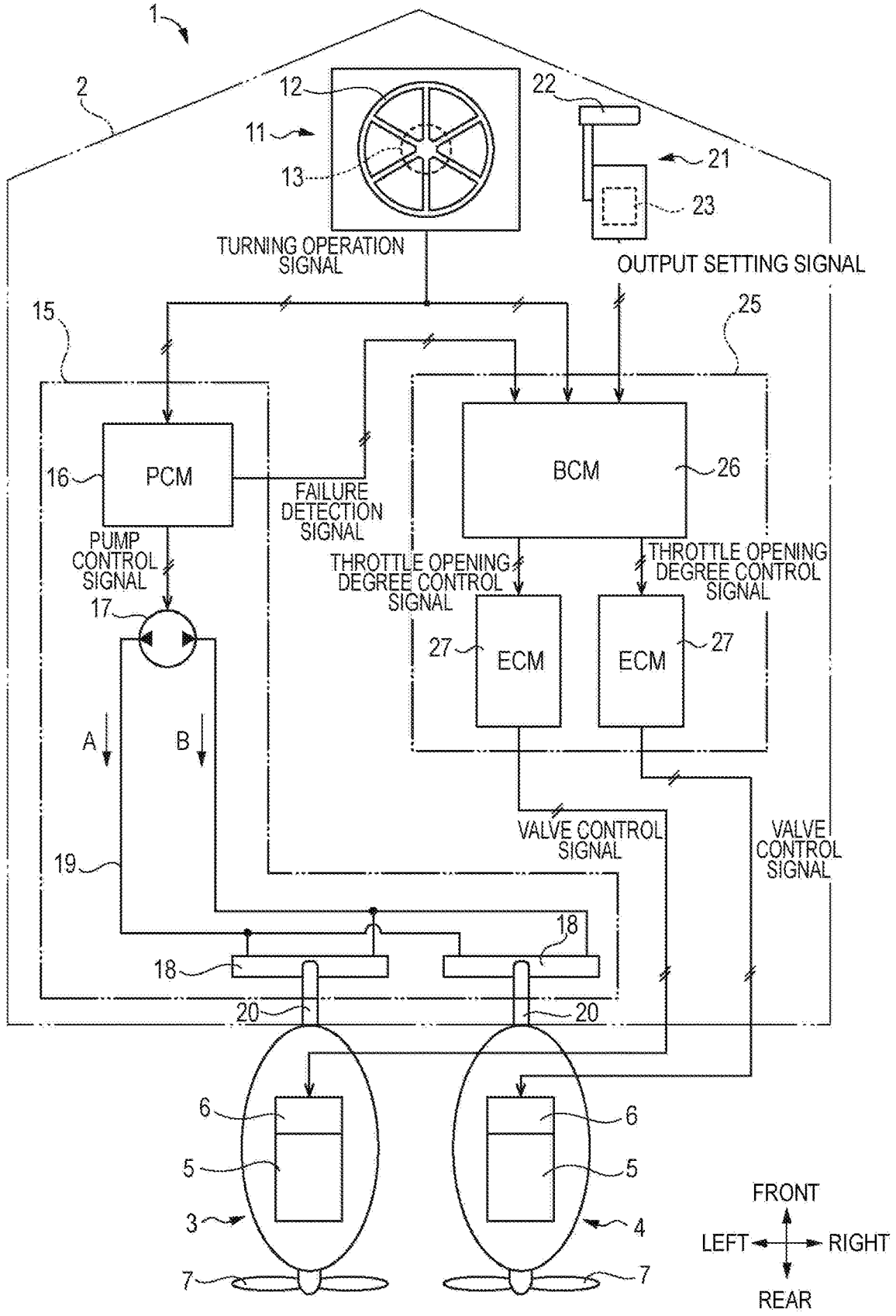
FIG. 1 is a diagram illustrating a ship maneuvering system according to an embodiment of the present invention.

A ship maneuvering system according to an embodiment of the present invention is a system for performing ship maneuvering control on a ship attached with two or more ship propulsion machines, and includes a turning operation device, a turning control device, an output operation device, and an output control device.

The turning operation device is a device configured to output a turning operation signal corresponding to a turning operation for turning the ship by changing a direction of each of the ship propulsion machines. The turning operation device can include, for example, a handle provided in front of a maneuvering seat of the ship, and a detection unit configured to detect an operation direction and an operation amount of the handle.

The turning control device is a device configured to change the direction of each of the ship propulsion machines based on the turning operation signal output from the turning operation device. The turning control device can include, for example, an actuator for rotating each of the ship propulsion machines in a horizontal direction, and a control circuit configured to control drive of the actuator based on the turning operation signal.

The output operation device is a device configured to output an output setting signal indicating an output of a power source of each of the ship propulsion machines set by an output setting operation for setting the output of the power source of each of the ship propulsion machines. The output operation device can include, for example, a throttle lever provided on a side of the maneuvering seat of the ship, and a detection unit configured to detect a position of the throttle lever.

The output control device is a device configured to increase or decrease the output of the power source of each of the ship propulsion machines based on the output setting signal output from the output operation device. When the power source of each of the ship propulsion machines is an internal combustion engine, the output control device can include, for example, a control circuit configured to control an opening degree of a throttle valve in each of the ship propulsion machines based on the output setting signal. When the power source of each of the ship propulsion machines is an electric motor, the output control device can include a control circuit configured to control a rotation speed of the electric motor in each of the ship propulsion machines based on the output setting signal.

In the ship maneuvering system according to the embodiment of the present invention, the output control device has a function, when the turning control device fails, of turning the ship by making outputs of power sources of the two or more ship propulsion machines different from each other based on the turning operation signal output from the turning operation device. Specifically, when turning the ship to left based on the turning operation signal during failure of the turning control device, the output control device makes an output of a power source of a ship propulsion machine located on a right side of a center in a left-right direction of the ship, of the two or more ship propulsion machines attached to the ship, greater than an output of a power source of a ship propulsion machine located on a left side of the center in the left-right direction of the ship. On the other hand, when turning the ship to right based on the turning operation signal during failure of the turning control device, the output control device makes the output of the power source of the ship propulsion machine located on the left side of the center in the left-right direction of the ship, of the two or more ship propulsion machines attached to the ship, greater than the output of the power source of the ship propulsion machine located on the right side of the center in the left-right direction of the ship.

According to the ship maneuvering system of the embodiment of the present invention, the ship can be turned according to the operation of the turning operation device by the operator even when the turning control device fails.

Embodiment (Basic Configuration of Ship Maneuvering System)

FIG. 1 shows a configuration of a ship maneuvering system 1 according to the embodiment of the present invention. The ship maneuvering system 1 is a system for performing ship maneuvering control on a ship to which two or more ship propulsion machines are attached. The ship maneuvering system 1 according to the present embodiment is provided on a ship 2 to which two outboard machines 3 and 4, each having an internal combustion engine 5 as a power source, are attached. In the ship 2, of the two outboard machines 3 and 4, the outboard machine 3 is disposed on the left side of the center in the left-right direction of the ship 2, and the outboard machine 4 is disposed on the right side of the center in the left-right direction of the ship 2.

As shown in FIG. 1, the ship maneuvering system 1 includes a turning operation device 11, a turning control device 15, an output operation device 21, and an output control device 25.

The turning operation device 11 is a device for the operator to perform a turning operation. The turning operation is an operation for turning the ship 2 and changing a traveling direction of the ship 2, by changing a direction of each outboard machine 3, 4. The turning operation device 11 includes a handle 12 and a handle operation sensor 13.

The handle 12 is disposed in front of the maneuvering seat of the ship 2, for example. The operator performs the turning operation by grasping and turning the handle 12.

The handle operation sensor 13 is a device configured to detect an operation direction and an operation amount of the handle 12. As the handle operation sensor 13, for example, a well-known steering angle sensor using magnetism can be used. The operation direction and the operation amount of the handle 12 correspond to an operation direction and an operation amount of the turning operation. The handle operation sensor 13 outputs a turning operation signal indicating the operation direction and the operation amount of the handle 12, that is, the operation direction and the operation amount of the turning operation, to the turning control device 15 and the output control device 25.

The turning control device 15 is a device configured to change the direction of each outboard machine 3, 4 by rotating each outboard machine 3, 4 in the horizontal direction based on the turning operation signal output from the turning operation device 11. The turning control device 15 includes a pump control module (PCM) 16, a hydraulic pump 17, two hydraulic cylinders 18, and a hydraulic circuit 19. The hydraulic cylinder 18 is provided for each outboard machine 3, 4.

The PCM 16 is a control circuit configured to control the hydraulic pump 17 based on the turning operation signal output from the turning operation device 11, and includes, for example, a microcomputer and a memory. According to the turning operation signal, the PCM 16 outputs a pump control signal to the hydraulic pump 17 for controlling the hydraulic pump 17. The hydraulic pump 17 is a pump configured to supply hydraulic oil to each hydraulic cylinder 18 via the hydraulic circuit 19 in order to operate each hydraulic cylinder 18. Each hydraulic cylinder 18 is a device configured to rotate the outboard machines 3 and 4 in the horizontal direction. Each hydraulic cylinder 18 is connected to the outboard machines 3 and 4 via a connection member 20. The hydraulic circuit 19 is a hydraulic circuit configured to connect the hydraulic pump 17 and each hydraulic cylinder 18.

Figure 2A:
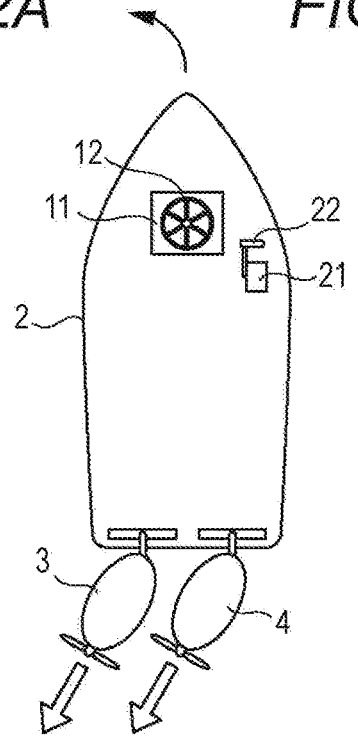
FIGS. 2A and 2B are diagrams each illustrating a state where a ship turns when a turning control device does not fail, in a ship to which the ship maneuvering system according to the embodiment of the present invention is applied.
Figure 2B:
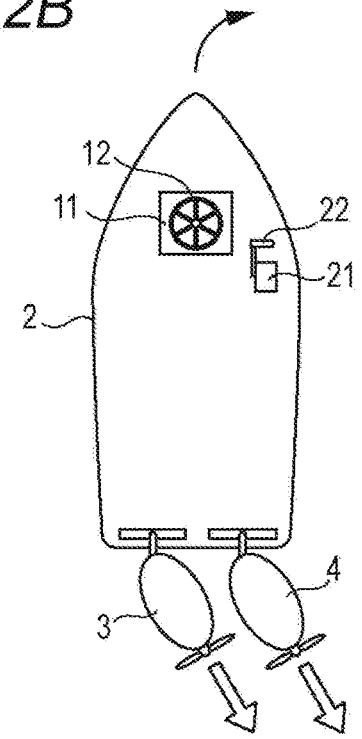

For example, in the case of turning the ship 2 to the left based on the turning operation signal, the PCM 16 controls the hydraulic pump 17 to pressurize the hydraulic oil in the hydraulic circuit 19 in a direction of arrow A in FIG. 1. Accordingly, each hydraulic cylinder 18 operates under the pressure of the hydraulic oil, each outboard machine 3, 4 rotates clockwise in FIG. 1, and a propeller 7 of each outboard machine 3, 4 faces left rearward. FIG. 2A shows a state where the ship 2 turns to the left by such control. On the other hand, in the case of turning the ship 2 to the right based on the turning operation signal, the PCM 16 controls the hydraulic pump 17 to pressurize the hydraulic oil in the hydraulic circuit 19 in a direction of arrow B in FIG. 1. Accordingly, each hydraulic cylinder 18 operates under the pressure of the hydraulic oil, each outboard machine 3, 4 rotates counterclockwise in FIG. 1, and the propeller 7 of each outboard machine 3, 4 faces right rearward. FIG. 2B shows a state where the ship 2 turns to the right by such control. Further, the PCM 16 controls a rotation amount of each outboard machine 3, 4 according to the operation amount of the turning operation indicated by the turning operation signal.

The output operation device 21 is a device for the operator to perform an output setting operation. The output setting operation is an operation for setting a magnitude of an output of the internal combustion engine 5 of each outboard machine 3, 4. A propulsive force of the ship 2 is determined by the output of the internal combustion engine 5 of each outboard machine 3, 4. As shown in FIG. 1, the output operation device 21 includes a throttle lever 22 and a lever operation sensor 23.

The throttle lever 22 is disposed, for example, on the side of the maneuvering seat of the ship 2. The operator grips the throttle lever 22 and changes a position (tilt angle) of the throttle lever to perform the output setting operation.

The lever operation sensor 23 is a device configured to detect the position of the throttle lever 22. A well-known position sensor, tilt angle sensor, or the like can be used as the lever operation sensor 23. The position of the throttle lever 22 indicates a set value of the output of the internal combustion engine 5 of each outboard machine 3, 4 set by the output setting operation (hereinafter, this is referred to as an "output set value"). The lever operation sensor 23 outputs, to the output control device 25, the output setting signal indicating the position of the throttle lever 22, that is, the output set value of the internal combustion engine 5 of each outboard machine 3, 4 set by the output setting operation. In the present embodiment, it is assumed that the output set value of the internal combustion engine 5 of the outboard machine 3 on the left side and the output set value of the internal combustion engine 5 of the outboard machine 4 on the right side set by the output setting operation are equal to each other. When the operator changes the position of the throttle lever 22, the output set value of the internal combustion engine 5 of the outboard machine 3 on the left side and the output set value of the internal combustion engine 5 of the outboard machine 4 on the right side increase or decrease at the same time and to the same extent.

The output control device 25 is a device configured to increase or decrease the output of the internal combustion engine 5 of each outboard machine 3, 4 based on the output setting signal output from the output operation device 21. Specifically, the output control device 25 is a control circuit configured to electronically control the opening degree of the throttle valve (throttle opening degree) of each outboard machine 3, 4 based on the output setting signal. The output control device 25 includes a boat control module (BCM) 26 and two engine control modules (ECMs) 27. The ECM 27 is provided for each outboard machine 3, 4.

The BCM 26 is a control circuit configured to calculate the throttle opening degree based on the output setting signal output from the output operation device 21 and to output a throttle opening degree control signal indicating the calculated throttle opening degree to each ECM 27. The BCM 26 includes, for example, a microcomputer and a memory. Each ECM 27 is a control circuit configured to output a valve control signal for controlling an electronic throttle valve 6 provided in each outboard machine 3, 4 to the throttle valve 6 of each outboard machine 3, 4, based on the throttle opening degree control signal output from the BCM 26.

Basically, when the output set value of the internal combustion engine 5 of each outboard machine 3, 4 indicated by the output setting signal increases, the BCM 26 controls the throttle valve 6 of each outboard machine 3, 4 so as to increase the throttle opening degree of each outboard machine 3, 4. When the throttle opening degree of each outboard machine 3, 4 is increased, the output of the internal combustion engine 5 of each outboard machine 3, 4 increases, and the propulsive force of the ship 2 increases. Basically, when the output set value of the internal combustion engine 5 of each outboard machine 3, 4 indicated by the output setting signal decreases, the BCM 26 controls the throttle valve 6 of each outboard machine 3, 4 so as to decrease the throttle opening degree of each outboard machine 3, 4. When the throttle opening degree of each outboard machine 3, 4 is decreased, the output of the internal combustion engine 5 of each outboard machine 3, 4 decreases, and the propulsive force of the ship 2 decreases. Basically, when the turning control device 15 does not fail, the BCM 26 controls the throttle valve 6 of each outboard machine 3, 4 such that the output of the internal combustion engine 5 of the outboard machine 3 on the left side and the output of the internal combustion engine 5 of the outboard machine 4 on the right side are equal to each other.

(Fail Safe Function of Ship Maneuvering System)

The ship maneuvering system 1 has a fail safe function that enables the ship 2 to turn even when the turning control device 15 fails. Specifically, the ship maneuvering system 1 detects the failure of the turning control device 15 by the PCM 16, and when the failure of the turning control device 15 is detected, the BCM 26 makes the outputs of the internal combustion engines 5 of the two outboard machines 3 and 4 different from each other based on the turning operation signal output from the turning operation device 11, thereby turning the ship 2.

That is, the PCM 16 detects the failure of the turning control device 15. For example, despite the detection of the operation of the hydraulic pump 17, the operation of the hydraulic cylinder 18, or the pressure change of the hydraulic oil in the hydraulic circuit 19, and an output of a pump control signal for driving the hydraulic pump 17, when the hydraulic pump 17 does not operate, the hydraulic cylinder 18 does not operate, or the pressure of the hydraulic oil in the hydraulic circuit 19 does not change, the PCM 16 determines that the turning control device 15 fails. When the turning control device 15 fails, the PCM 16 outputs a failure detection signal to the BCM 26.

The BCM 26 recognizes the failure of the turning control device 15 based on the failure detection signal output from the PCM 16. In the ship maneuvering system 1, as shown in FIG. 1, the turning operation signal from the turning operation device 11 is output not only to the PCM 16 of the turning control device 15 but also to the BCM 26 of the output control device 25. When the failure of the turning control device 15 is recognized and the turning operation signal is output from the turning operation device 11, the BCM 26 controls the throttle opening degrees of the two outboard machines 3 and 4, based on the operation direction and the operation amount of the turning operation indicated by the turning operation signal. Accordingly, the outputs of the internal combustion engines 5 of the two outboard machines 3 and 4 are made different from each other, and the ship 2 is turned.

Figure 3A:
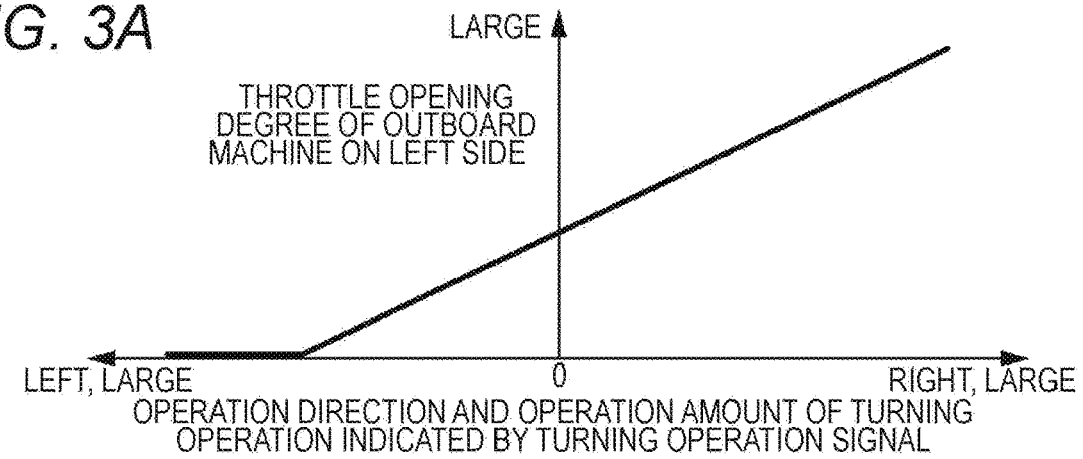
FIGS. 3A and 3B are graphs each showing a relationship between an operation direction and an operation amount of a turning operation and a throttle opening degree of each outboard machine controlled by an output control device based on the operation direction and the operation amount, when a failure of the turning control device is recognized in the ship maneuvering system according to the embodiment of the present invention.
Figure 3B:
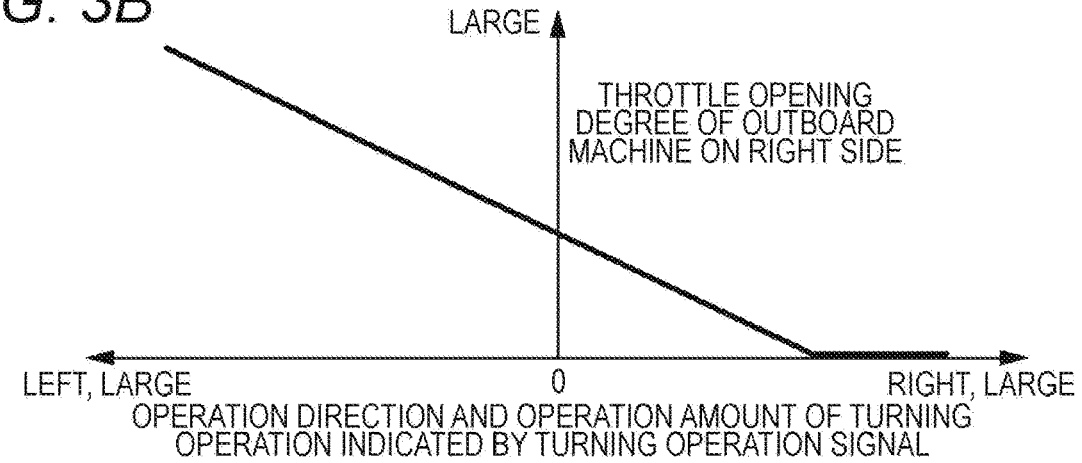

FIG. 3A shows a relationship between the operation direction and the operation amount of the turning operation indicated by the turning operation signal and the throttle opening degree of the outboard machine 3 on the left side controlled by the output control device 25 based on the operation direction and the operation amount, when the failure of the turning control device 15 is recognized. FIG. 3B shows a relationship between the operation direction and the operation amount of the turning operation indicated by the turning operation signal and the throttle opening degree of the outboard machine 4 on the right side controlled by the output control device 25 based on the operation direction and the operation amount, when the failure of the turning control device 15 is recognized.

When the failure of the turning control device 15 is recognized and the operation direction of the turning operation indicated by the turning operation signal is a left direction, as shown in FIG. 3A, the BCM 26 controls the throttle valve 6 of the outboard machine 3 on the left side such that the throttle opening degree of the outboard machine 3 on the left side decreases as the operation amount of the turning operation in the left direction increases, and at the same time, as shown in FIG. 3B, the BCM 26 controls the throttle valve 6 of the outboard machine 4 on the right side such that the throttle opening degree of the outboard machine 4 on the right side increases as the operation amount of the turning operation in the left direction increases.

On the other hand, when the failure of the turning control device 15 is recognized and the operation direction of the turning operation indicated by the turning operation signal is a right direction, as shown in FIG. 3A, the BCM 26 controls the throttle valve 6 of the outboard machine 3 on the left side such that the throttle opening degree of the outboard machine 3 on the left side increases as the operation amount of the turning operation in the right direction increases, and at the same time, as shown in FIG. 3B, the BCM 26 controls the throttle valve 6 of the outboard machine 4 on the right side such that the throttle opening degree of the outboard machine 4 on the right side decreases as the operation amount of the turning operation in the right direction increases.

In addition, the BCM 26 limits the output of the internal combustion engine 5 of each outboard machine 3, 4 when the failure of the turning control device 15 is recognized, as compared with the case where the failure of the turning control device 15 is not recognized. Specifically, the BCM 26 decreases the throttle opening degree of each outboard machine 3, 4, which is determined based on the output set value of the internal combustion engine 5 of each outboard machine 3, 4 indicated by the output setting signal (output set value of the internal combustion engine 5 of each outboard machine 3, 4 set by the output setting operation) when the failure of the turning control device 15 is recognized, as compared with the case where the failure of the turning control device 15 is not recognized. For example, the BCM 26 sets the throttle opening degree of each outboard machine 3, 4, which is determined based on the output set value of the internal combustion engine 5 of each outboard machine 3, 4 indicated by the output setting signal when the failure of the turning control device 15 is recognized, to be about 50% to 70% of a throttle opening degree of each outboard machine 3, 4, which is determined based on the output set value of the internal combustion engine 5 of each outboard machine 3, 4 indicated by the output setting signal when the failure of the turning control device 15 is not recognized.

Figure 4:
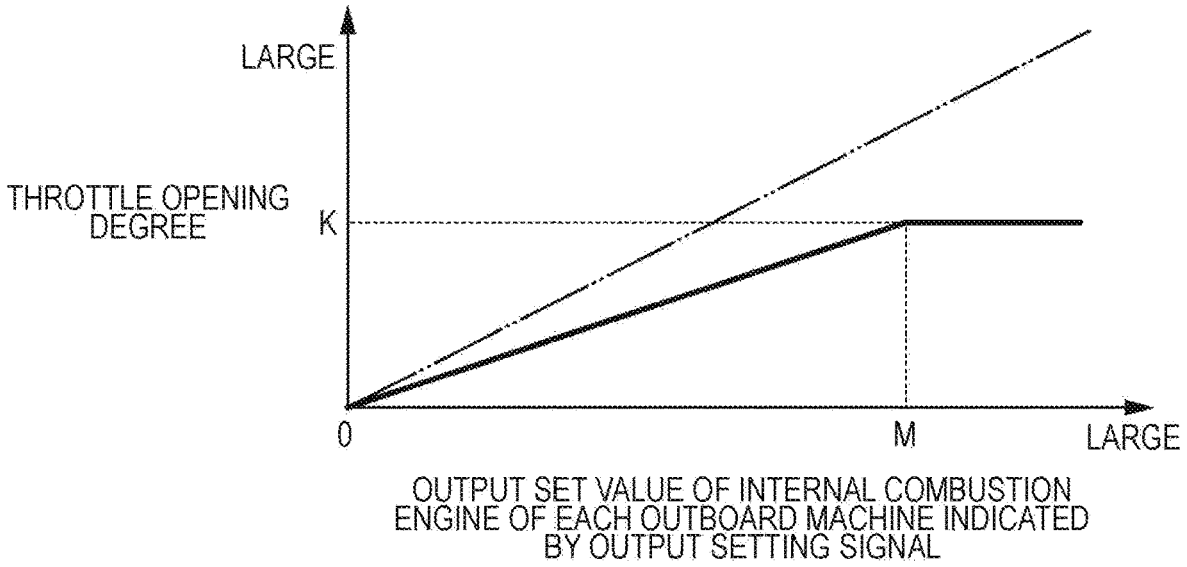
FIG. 4 is a graph showing a relationship between a set value of an output of an internal combustion engine of each outboard machine set by an output setting operation and the throttle opening degree of each outboard machine controlled by the output control device based on the set value, in the ship maneuvering system according to the embodiment of the present invention.

A two-dot chain line in a graph in FIG. 4 shows a relationship between the output set value of the internal combustion engine 5 of each outboard machine 3, 4 indicated by the output setting signal and the throttle opening degree of each outboard machine 3, 4 determined by the output control device 25 based on the output set value, when the failure of the turning control device 15 is not recognized. In addition, a solid line in the graph in FIG. 4 shows a relationship between the output set value of the internal combustion engine 5 of each outboard machine 3, 4 indicated by the output setting signal and the throttle opening degree of each outboard machine 3, 4 determined by the output control device 25 based on the output set value, when the failure of the turning control device 15 is recognized.

As shown in FIG. 4, in a case where the output set value of the internal combustion engine 5 of each outboard machine 3, 4 indicated by the output setting signal is within a range of greater than 0 and equal to or less than a predetermined threshold value M, the BCM 26 controls the throttle valve 6 of each outboard machine 3, 4 such that the throttle opening degree corresponding to the output set value of the internal combustion engine 5 of each outboard machine 3, 4 indicated by the output setting signal when the failure of the turning control device 15 is recognized is smaller than the throttle opening degree corresponding to the output set value of the internal combustion engine 5 of each outboard machine 3, 4 indicated by the output setting signal when the failure of the turning control device 15 is not recognized.

In addition, in a case where the output set value of the internal combustion engine 5 of each outboard machine 3, 4 indicated by the output setting signal when the failure of the turning control device 15 is recognized is more than the threshold value M, the BCM 26 controls the throttle valves 6 of each outboard machine 3, 4 to keep the throttle opening degree in a predetermined opening degree K regardless of the output set value of the internal combustion engine 5 of each outboard machine 3, 4 indicated by the output setting signal.

In this way, when the failure of the turning control device 15 is recognized and the turning operation signal is output from the turning operation device 11, the BCM 26 determines the throttle opening degrees of the two outboard machines 3 and 4 based on the operation direction and the operation amount of the turning operation indicated by the turning operation signal, and controls the ship 2 to turn. Here, this control is referred to as "turning control during failure". Further, the BCM 26 decreases the throttle opening degree of each outboard machine 3, 4, which is determined based on the output set value of the internal combustion engine 5 of each outboard machine 3, 4 indicated by the output setting signal, when the failure of the turning control device 15 is recognized, as compared with the case where the failure of the turning control device 15 is not recognized, and controls to limit the output of the internal combustion engine 5 of each outboard machine 3, 4. Here, this control is referred to as "output limit control during failure". In the present embodiment, when the failure of the turning control device 15 is recognized and the turning operation signal is output from the turning operation device 11, the BCM 26 simultaneously performs the turning control during failure and the output limit control during failure as follows.

That is, a control table, a control map, or a calculation formula, which indicates the relationship (for example, the relationship shown in FIG. 3A) between the operation direction and the operation amount of the turning operation indicated by the turning operation signal and the throttle opening degree of the outboard machine 3 on the left side to be determined by the output control device 25 based on the operation direction and the operation amount when the failure of the turning control device 15 is recognized, is stored in the memory of the BCM 26, in advance. Then, when the failure of the turning control device 15 is recognized and the turning operation signal is output from the turning operation device 11, the BCM 26 uses the control table, control map or calculation formula to calculate a control variable $V_L$ for determining the throttle opening degree of the outboard machine 3 on the left side according to the operation direction and the operation amount of the turning operation indicated by the turning operation signal. Next, the BCM 26 uses the control variable $V_L$, an output set value $P_L$ of the internal combustion engine 5 of the outboard machine 3 on the left side indicated by the output setting signal output from the output operation device 21 at this time, and a correction value C (for example, 0.5 to 0.7) for limiting the output of the internal combustion engine 5 of each outboard machine 3, 4 when the failure of the turning control device 15 is recognized to perform next calculation, and calculates a throttle opening degree set value $T_{LT}$ of the outboard machine 3 on the left side during turning.

$$T_{LT}=V_L\times P_L\times C \quad \text{(F1)}$$

When the value of $V_L\times P_L$ is more than the threshold value M, the BCM 26 sets the throttle opening degree set value $T_{LT}$ to the predetermined opening degree K.

In addition, a control table, a control map, or a calculation formula, which indicates the relationship (for example, the relationship shown in FIG. 3B) between the operation direction and the operation amount of the turning operation indicated by the turning operation signal and the throttle opening degree of the outboard machine 4 on the right side to be determined by the output control device 25 based on the operation direction and the operation amount when the failure of the turning control device 15 is recognized, is stored in the memory of the BCM 26, in advance. Then, when the failure of the turning control device 15 is recognized and the turning operation signal is output from the turning operation device 11, the BCM 26 uses the control table, control map or calculation formula to calculate a control variable $V_R$ for determining the throttle opening degree of the outboard machine 4 on the right side according to the operation direction and the operation amount of the turning operation indicated by the turning operation signal. Next, the BCM 26 uses the control variable $V_R$, an output set value $P_R$ of the internal combustion engine 5 of the outboard machine 4 on the right side indicated by the output setting signal output from the output operation device 21 at this time, and the correction value C to perform next calculation, and calculates a throttle opening degree set value $T_{RT}$ of the outboard machine 4 on the right side during turning.

$$T_{RT}=V_R\times P_R\times C \quad \text{(F2)}$$

When the value of $V_R\times P_R$ is more than the threshold value M, the BCM 26 sets the throttle opening degree set value $T_{RT}$ to the predetermined opening degree K.

Then, the BCM 26 controls the throttle valve 6 of the outboard machine 3 on the left side such that the throttle opening degree of the outboard machine 3 on the left side is the throttle opening degree set value $T_{LT}$, and controls the throttle valve 6 of the outboard machine 4 on the right side such that the throttle opening degree of the outboard machine 4 on the right side is the throttle opening degree set value $T_{RT}$.

Figure 5A:
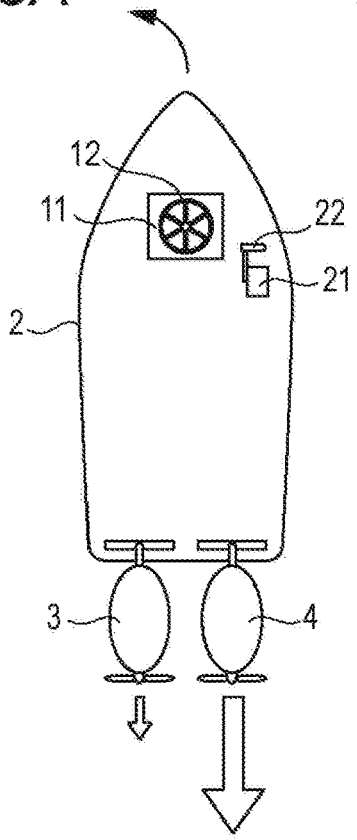
FIGS. 5A and 5B are diagrams each illustrating a state where the ship turns when the turning control device fails, in the ship to which the ship maneuvering system according to the embodiment of the present invention is applied.

Here, FIG. 5A show a state where the BCM 26 turns the ship 2 to the left by performing the turning control during failure and the output limit control during failure at the same time when the failure of the turning control device 15 is recognized and the turning operation signal for turning the ship 2 to the left is output from the turning operation device 11. As shown in FIG. 5A, when the failure of the turning control device 15 is recognized and the turning operation signal for turning the ship 2 to the left is output from the turning operation device 11, with the turning control during failure and the output limit control during failure, of the two or more outboard machines 3 and 4 attached to the ship, the output of the internal combustion engine 5 of the outboard machine 4 located on the right side of the center in the left-right direction of the ship 2 is larger than the output of the internal combustion engine 5 of the outboard machine 3 located on the left side of the center in the left-right direction of the ship 2. Therefore, the ship 2 turns to the left.

Figure 5B:
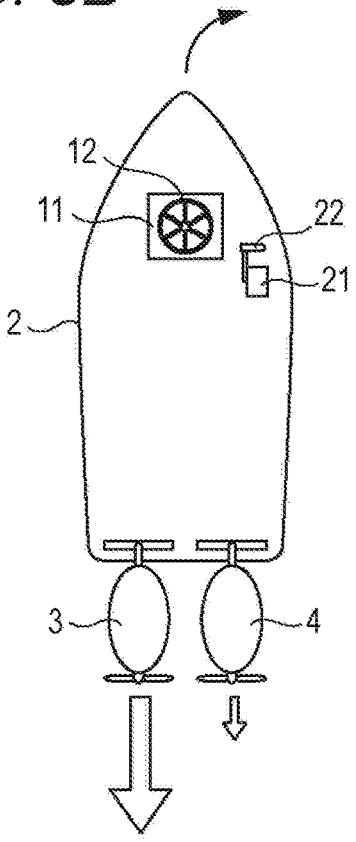

In addition, FIG. 5B show a state where the BCM 26 turns the ship 2 to the right by performing the turning control during failure and the output limit control during failure at the same time when the failure of the turning control device 15 is recognized and the turning operation signal for turning the ship 2 to the right is output from the turning operation device 11. As shown in FIG. 5B, when the failure of the turning control device 15 is recognized and the turning operation signal for turning the ship 2 to the right is output from the turning operation device 11, with the turning control during failure and the output limit control during failure, of the two or more outboard machines 3 and 4 attached to the ship, the output of the internal combustion engine 5 of the outboard machine 3 located on the left side of the center in the left-right direction of the ship 2 is larger than the output of the internal combustion engine 5 of the outboard machine 4 located on the right side of the center in the left-right direction of the ship 2. Therefore, the ship 2 turns to the right.

(Operation of Ship Maneuvering System)

Figure 6:
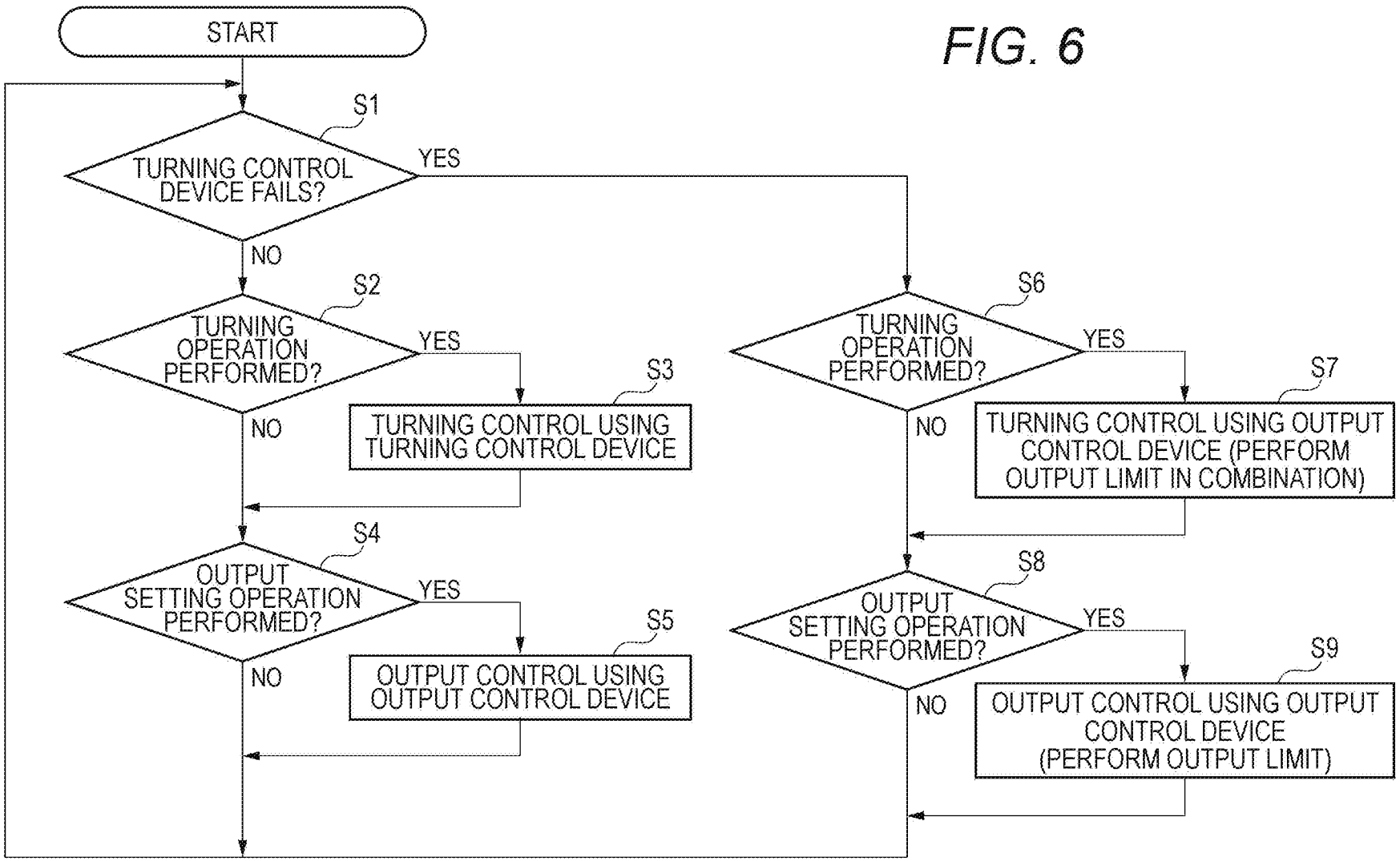
FIG. 6 is a flowchart showing an operation of the ship maneuvering system according to the embodiment of the present invention.

The overall operation of the ship maneuvering system 1 having the above configuration will be described. FIG. 6 shows the operation of the ship maneuvering system 1.

In FIG. 6, in a case where the failure of the turning control device 15 is not detected by the PCM 16 during the operation of the ship maneuvering system 1, and therefore the BCM 26 does not recognize the failure of the turning control device 15 (step S1: NO), when the operator performs a turning operation using the handle 12, the handle operation sensor 13 of the turning operation device 11 detects the turning operation (step S2: YES), and a turning operation signal indicating the operation direction and the operation amount of the turning operation is output to the PCM 16 of the turning control device 15 and the BCM 26 of the output control device 25.

Then, the PCM 16 of the turning control device 15 controls the hydraulic pump 17 and each hydraulic cylinder 18 based on the operation direction and operation amount of the turning operation indicated by the turning operation signal output from the handle operation sensor 13, and rotates each outboard machine 3, 4 in the horizontal direction, so as to change the direction of each outboard machine 3, 4 (step S3). Accordingly, the ship 2 turns according to the turning operation of the operator.

Further, in a case where the BCM 26 does not recognize the failure of the turning control device 15, when the operator uses the throttle lever 22 to perform the output setting operation, the lever operation sensor 23 of the output operation device 21 detects the output setting operation (step S4: YES), and an output setting signal indicating the output set value of the internal combustion engine 5 of each outboard machine 3, 4 set by the output setting operation is output to the output control device 25.

Then, the BCM 26 of the output control device 25 controls the throttle opening degree of each outboard machine 3, 4 based on the output set value of the internal combustion engine 5 of each outboard machine 3, 4 indicated by the output setting signal output from the lever operation sensor 23, and increases or decreases the output of the internal combustion engine 5 of each outboard machine 3, 4 (step S5). Accordingly, the speed of the ship 2 increases or decreases according to the output setting operation of the operator.

On the other hand, when the failure of the turning control device 15 is detected by the PCM 16, the BCM 26 recognizes that the turning control device 15 has failed based on the failure detection signal output from the PCM 16 (step S1: YES). Then, in a case where the BCM 26 recognizes the failure of the turning control device 15, when the operator performs the turning operation using the handle 12 (step S6: YES), the handle operation sensor 13 of the turning operation device 11 detects the turning operation, and a turning operation signal indicating the operation direction and the operation amount of the turning operation is output to the PCM 16 of the turning control device 15 and the BCM 26 of the output control device 25.

Then, as described above, the BCM 26 of the output control device 25 calculates the control variable $V_L$ based on the operation direction and the operation amount of the turning operation indicated by the turning operation signal output from the handle operation sensor 13, and uses the control variable $V_L$, the output set value $P_L$ and the correction value C to perform calculation of the above formula F1 to calculate the throttle opening degree set value $T_{LT}$ of the outboard machine 3 on the left side during turning. Further, the BCM 26 calculates the control variable $V_R$ based on the operation direction and the operation amount of the turning operation indicated by the turning operation signal output from the handle operation sensor 13, and uses the control variable $V_R$, the output set value $P_R$ and the correction value C to perform calculation of the above formula F2 to calculate the throttle opening degree set value $T_{RT}$ of the outboard machine 4 on the right side during turning. Then, the BCM 26 controls the throttle valve 6 of the outboard machine 3 on the left side such that the throttle opening degree of the outboard machine 3 on the left side is the throttle opening degree set value $T_{LT}$, and controls the throttle valve 6 of the outboard machine 4 on the right side such that the throttle opening degree of the outboard machine 4 on the right side is the throttle opening degree set value $T_{RT}$. As a result of this control, a difference occurs between the output of the internal combustion engine 5 of the outboard machine 3 on the left side and the output of the internal combustion engine 5 of the outboard machine 4 on the right side according to the operation direction and the operation amount of the turning operation. Accordingly, the ship 2 turns according to the turning operation of the operator, despite a state where the direction of each outboard machine 3, 4 cannot be changed due to the failure of the turning control device 15.

Further, in a case where the BCM 26 recognizes the failure of the turning control device 15, when the operator uses the throttle lever 22 to perform the output setting operation, the lever operation sensor 23 of the output operation device 21 detects the output setting operation (step S8: YES), and an output setting signal indicating the output set value of the internal combustion engine 5 of each outboard machine 3, 4 set by the output setting operation is output to the output control device 25.

Then, the BCM 26 of the output control device 25 controls the throttle opening degree of each outboard machine 3, 4 based on the output set values $P_L$ and $P_R$ of the internal combustion engines 5 of respective outboard machines 3 and 4 indicated by the output setting signal output from the lever operation sensor 23 and the above correction value C (for example, 0.5 to 0.7), and increases or decreases the output of the internal combustion engine 5 of each outboard machine 3, 4 (step S9). For example, when the ship 2 travels straight, the BCM 26 performs the following calculation using the output set values $P_L$ and $P_R$ and the above correction value C, so as to calculate a throttle opening degree set value $T_{LS}$ of the outboard machine 3 on the left side during straight traveling and a throttle opening degree set value $T_{RS}$ of the outboard machine 4 on the right side during straight traveling.

$$T_{LS}=P_L\times C \tag{F3}$$

$$T_{RS}=P_R\times C \tag{F4}$$

When any one of the output set values $P_L$ and $P_R$ is more than the threshold value M, the BCM 26 sets the throttle opening degree set values $T_{LS}$ and $T_{RS}$ to the predetermined opening degree K.

Then, the BCM 26 controls the throttle valve 6 of the outboard machine 3 on the left side such that the throttle opening degree of the outboard machine 3 on the left side is the throttle opening degree set value $T_{LS}$, and controls the throttle valve 6 of the outboard machine 4 on the right side such that the throttle opening degree of the outboard machine 4 on the right side is the throttle opening degree set value $T_{RS}$. Accordingly, when the turning control device 15 fails, a propulsive force when the ship 2 travels straight is set according to the output setting operation of the operator, but the propulsive force when the ship 2 travels straight is limited as compared with the case where the turning control device 15 does not fail. That is, even when the operator performs the output setting operation to increase the speed of ship 2 during straight traveling, a degree to which the speed of the ship 2 during straight traveling increases in the case where the turning control device 15 fails is smaller than that in the case where the turning control device 15 does not fail.

As described above, according to the ship maneuvering system 1 of the embodiment of the present invention, even when the directions of the outboard machines 3 and 4 cannot be changed due to the failure of the turning control device 15, the ship 2 can be turned by making the outputs of the internal combustion engines 5 of the two outboard machines 3 and 4 different from each other based on the turning operation signal output from the turning operation device 11. Therefore, when the turning control device 15 fails, the operator can turn the ship 2 by the same operation method as in the case where the turning control device 15 does not fail, that is, by turning the handle 12.

In a case where the operation method for turning the ship 2 is different between the case where the turning control device 15 fails and the case where the turning control device 15 does not fail, when the turning control device 15 fails, the operator cannot turn the ship 2 by the operation method that he or she is accustomed to, so that it may be difficult for the operator to perform the operation of turning the ship 2, or the operator may feel the anxiety in operation. It is also conceivable that the operation method for turning the ship 2 when the turning control device 15 fails is forgotten, and that the operation of turning the ship 2 cannot be performed. In contrast, according to the ship maneuvering system 1 of the embodiment of the present invention, the operation method for turning the ship 2 is the same in the case where the turning control device 15 fails and the case where the turning control device 15 does not fail, so that such a problem does not occur. Therefore, the operator can easily, reliably, and safely turn the ship 2 when the turning control device 15 fails.

In the ship maneuvering system 1 according to the present embodiment, the output of the internal combustion engine 5 of each outboard machine 3, 4 when the failure of the turning control device 15 is recognized, is limited as compared with the case where the turning control device 15 does not fail. Accordingly, when turning the ship 2 during the failure of the turning control device 15, it is possible to prevent the output of the internal combustion engines 5 of the outboard machines 3 and 4 from being too large and the behavior of the ship 2 being unstable. In addition, when the turning control device 15 fails, the output of the internal combustion engine 5 of each outboard machine 3, 4 during straight traveling of the ship 2 is also limited. Accordingly, it is possible to prevent the behavior of the ship 2 from being unstable due to, for example, turning immediately after traveling straight at a high speed.

In addition, in the ship maneuvering system 1 according to the present embodiment, when the turning control device 15 fails, the operation direction and the operation amount of the turning operation indicated by the turning operation signal output from the turning operation device 11, the output set value of the internal combustion engine 5 of each outboard machine 3, 4 indicated by the output setting signal output from the output operation device 21, and the correction value for limiting the output of the internal combustion engine 5 of each outboard machine 3, 4 are used to perform calculation, so as to determine the output of the internal combustion engine 5 of each outboard machine 3, 4 (the throttle opening degree of each outboard machine 3, 4). With this configuration, the control for turning the ship 2 by an output difference of the internal combustion engines 5 of the two outboard machines 3 and 4, and the control for limiting the output of the internal combustion engine 5 of each outboard machine 3, 4 can be performed quickly and reliably based on simple calculation.

The type and size of the ship to which the ship maneuvering system according to the present invention is applied, is not limited. In addition, each ship propulsion machine attached to the ship to which the ship maneuvering system according to the present invention is applied is not limited to an outboard machine, but may be an inboard/outboard machine. Further, the power source of each ship propulsion machine is not limited to an internal combustion engine, but may be an electric motor. When the power source of each ship propulsion machine is an electric motor, the output control device controls to increase or decrease the rotation speed of each electric motor based on the output setting signal. Further, in the turning control device, the actuator configured to change the direction of each ship propulsion machine is not limited to a hydraulic type actuator. Further, the ship maneuvering system according to the present invention can also be applied to a ship attached with three or more ship propulsion machines.

In the above embodiment, as shown in FIG. 3A and FIG. 3B, an example in which when the operation direction of the turning operation is left, the throttle opening degree of the outboard machine 3 on the left side is controlled to decrease according to the operation amount of the turning operation and the throttle opening degree of the outboard machine 4 on the right side is controlled to increase according to the operation amount of the turning operation, and when the operation direction of the turning operation is right, the throttle opening degree of the outboard machine 3 on the left side is controlled to increase according to the operation amount of the turning operation and the throttle opening degree of the outboard machine 4 on the right side is controlled to decrease according to the operation amount of the turning operation has been described, but the present invention is not limited thereto. Alternatively, when the operation direction of the turning operation is left, the throttle opening degree of the outboard machine 3 on the left side may be controlled to be 0 and the throttle opening degree of the outboard machine 4 on the right side may be controlled to increase according to the operation amount of the turning operation, and when the operation direction of the turning operation is right, the throttle opening degree of the outboard machine 4 on the right side may be controlled to be 0 and the throttle opening degree of the outboard machine 3 on the left side may be controlled to increase according to the operation amount of the turning operation.

In addition, in the above embodiment, an example in which in the output limit control of the internal combustion engine 5 of each outboard machine 3, 4 during the failure of the turning control device 15, the throttle opening degree of each outboard machine 3, 4 is changed as shown by the solid line in the graph in FIG. 4 according to the output set value of the internal combustion engine 5 of each outboard machine 3, 4 indicated by the output setting signal has been described. However, the mode of changing the throttle opening degree of each outboard machine 3, 4 corresponding to the output set value of the internal combustion engine 5 of each outboard machine 3, 4 indicated by the output setting signal, is not limited to the above.

The present invention can be modified as appropriate without departing from the concept or spirit of the invention which can be read from the claims and the entire description, and the ship maneuvering system accompanying such a change is also included in the technical concept of the present invention.

What is claimed is:

1. A ship maneuvering system for performing ship maneuvering control on a ship attached with two or more ship propulsion machines, the ship maneuvering system comprising:

a turning operation device configured to output a turning operation signal corresponding to a turning operation for turning the ship by changing a direction of each of the ship propulsion machines;

a turning control device configured to change the direction of each of the ship propulsion machines based on the turning operation signal output from the turning operation device;

an output operation device configured to output an output setting signal indicating an output of a power source of each of the ship propulsion machines set by an output setting operation for setting the output of the power source of each of the ship propulsion machines; and an output control device configured to increase or decrease the output of the power source of each of the ship propulsion machines based on the output setting signal output from the output operation device, wherein when the turning control device fails, the output control device turns the ship by making outputs of power sources of the two or more ship propulsion machines different from each other based on the turning operation signal output from the turning operation device, wherein when the turning control device fails, the output control device limits the output of the power source of each of the ship propulsion machines as compared with a case where the turning control device does not fail, and wherein when the turning control device fails, the output control device determines the output of the power source of each of the ship propulsion machines by calculation using an operation amount of the turning operation indicated by the turning operation signal output from the turning operation device, a set value of the output of the power source of each of the ship propulsion machines indicated by the output setting signal output from the output operation device, and a correction value for limiting the output of the power source of each of the ship propulsion machines.

2. The ship maneuvering system according to claim 1, wherein when turning the ship to left based on the turning operation signal during failure of the turning control device, the output control device makes an output of a power source of a ship propulsion machine located on a right side of a center in a left-right direction of the ship, of the two or more ship propulsion machines attached to the ship, greater than an output of a power source of a ship propulsion machine located on a left side of the center in the left-right direction of the ship, and when turning the ship to right based on the turning operation signal during failure of the turning control device, the output control device makes the output of the power source of the ship propulsion machine located on the left side of the center in the left-right direction of the ship, of the two or more ship propulsion machines attached to the ship, greater than the output of the power source of the ship propulsion machine located on the right side of the center in the left-right direction of the ship.

3. The ship maneuvering system according to claim 1, wherein the power source of each of the ship propulsion machines is an internal combustion engine, and the output control device controls a throttle opening degree in each of the ship propulsion machines.

4. The ship maneuvering system according to claim 1, wherein the turning control device includes an actuator configured to rotate each of the ship propulsion machines in a horizontal direction.

* * * * *